US010912705B1

(12) United States Patent
Qin

(10) Patent No.: US 10,912,705 B1
(45) Date of Patent: Feb. 9, 2021

(54) RETRACTABLE MASSAGE ROLLER

(71) Applicant: NANTONG AVEC HEALTH FITNESS COMPANY LIMITED, Nantong (CN)

(72) Inventor: Shujun Qin, Nantong (CN)

(73) Assignee: NANTONG AVEC HEALTH FITNESS COMPANY LIMITED, Nantong (CN)

( * ) Notice: Subject to any disclaimer, the term of this patent is extended or adjusted under 35 U.S.C. 154(b) by 0 days.

(21) Appl. No.: 16/990,173

(22) Filed: Aug. 11, 2020

(30) Foreign Application Priority Data

Jun. 12, 2020 (CN) ..... 2020 1 0533384

(51) Int. Cl.
*A61H 15/00* (2006.01)

(52) U.S. Cl.
CPC ..... *A61H 15/00* (2013.01); *A61H 2015/0014* (2013.01); *A61H 2201/0107* (2013.01); *A61H 2201/0157* (2013.01); *A61H 2201/0161* (2013.01); *A61H 2201/0192* (2013.01)

(58) Field of Classification Search
CPC ..... A61H 15/00; A61H 2015/0014; A61H 2201/0161; A61H 2201/0157; A61H 2201/0192; A61H 2201/0107
See application file for complete search history.

(56) References Cited

U.S. PATENT DOCUMENTS

2011/0313333 A1* 12/2011 Nicholson ..... A61H 15/0092 601/120
2016/0008213 A1* 1/2016 Cheng ..... A61H 15/0092 601/120
2016/0113837 A1* 4/2016 Burson ..... A61H 15/0092 601/118
2018/0353370 A1* 12/2018 Liao ..... A61H 1/00
2019/0110947 A1* 4/2019 Ekema ..... A61H 15/0092
2019/0142688 A1* 5/2019 Darley ..... A63B 22/20 601/120
2019/0151189 A1* 5/2019 Morris ..... A61H 15/00
2019/0350799 A1* 11/2019 Matossian ..... A61H 1/00
2020/0038282 A1* 2/2020 Bui ..... A61H 7/001
2020/0188219 A1* 6/2020 Piucci, Jr. ..... A61H 1/00

* cited by examiner

*Primary Examiner* — Quang D Thanh
(74) *Attorney, Agent, or Firm* — WPAT, PC

(57) ABSTRACT

A retractable massage roller includes two end caps and multiple ring-shaped unit bodies arranged along an axial direction, the two end caps being respectively connected to outermost two unit bodies of the multiple unit bodies. Every three adjacent unit bodies are connected through multiple connecting rods, the multiple connecting rods are independent of the three adjacent unit bodies, each connecting rods is movably disposed on and passes through the three adjacent unit bodies and the three adjacent unit bodies are capable of sliding on the multiple connecting rods. Outermost two unit bodies of the three adjacent unit bodies are respectively positionally-limited at two ends of each connecting rod through first limiting mechanisms, when the retractable massage roller is in a stretched state. Every two adjacent unit bodies of the multiple unit bodies are positionally-limited through second limiting mechanisms, when the retractable massage roller is in a contracted state.

7 Claims, 5 Drawing Sheets

RETRACTABLE MASSAGE ROLLER

TECHNICAL FIELD

The disclosure relates to relates to a retractable massage roller.

BACKGROUND

At present, during yoga fitness exercise, in order to perform muscle stretching and traction exercises and massage on multiple parts of a human-body after the exercises, a retractable massage roller such as a yoga column is required. Although function of an existing yoga column is relatively complete, its volume cannot be changed, and the yoga column cannot be formed to be a small volume when it is stored or packed, and thus occupies a large space, and it is not facilitate to be stored or carried.

To this end, retractable yoga columns have appeared on the market. A Chinese Utility Patent No. CN 207679974 U announced in the Aug. 3, 2018 discloses a yoga column with retractable function, in which, for every two adjacent unit bodies, one of which is provided with a plug-in post, and the other unit body is provided with a corresponding plug-in hole. The plug-in post is capable of being inserted into the plug-in hole and movably sleeved therewith. It can be seen that the unit body and the plug-in column are integrated, and are connected in pairs. Since every two unit body are connected in a interpenetrating manner, during being stretched, the entire yoga column is easy to be stuck, not easy to be pulled open, not stable enough, and easy to deform and distort; and a user may be injured due to its deformation during use.

SUMMARY

In order to overcome the above shortcomings, a purpose of the disclosure is to provide a retractable massage roller, which is capable of providing better user experience during closing and stretching the retractable massage roller, being smoother stretching, being more stable in contracted and stretched states, and being less deformable.

In order to achieve the above purpose, the technical solution adopted by the disclosure is: a retractable massage roller, including two end caps and multiple ring-shaped unit bodies arranged along an axial direction, the two end caps being respectively connected to outermost two unit bodies of the multiple unit bodies; wherein every three adjacent unit bodies of the multiple unit bodies are connected through multiple connecting rods, the multiple connecting rods are independent of the three adjacent unit bodies, each of the multiple connecting rods is movably disposed on and passes through the three adjacent unit bodies and thereby the three adjacent unit bodies are capable of sliding on each of the multiple connecting rods; wherein outermost two unit bodies of the three adjacent unit bodies are respectively positionally-limited at two ends of each of the multiple connecting rods through first limiting mechanisms, in a situation of the retractable massage roller being in a stretched state; and wherein every two adjacent unit bodies of the multiple unit bodies are positionally-limited through second limiting mechanisms, in a situation of the retractable massage roller being in a contracted state.

The beneficial effect of the retractable massage roller of the disclosure is that: each unit body and each connecting rod are separated, independent, and cooperate with each other. A phenomenon of jams is effectively reduce, when the massage roller is stretched or contracted. Since the every three adjacent unit bodies are connected by multiple connecting rods, the retractable massage roller is more stable and is not easy to be bent and deformed when the retractable massage roller is stretched, compared with a massage roller in which every two adjacent unit bodies are connected with each other.

Preferably, the first limiting mechanisms are respectively disposed on the two ends of the connecting rod, each of the first limiting mechanisms includes a rigid limiter and a flexible limiter, the rigid limiter is located at an outer side, and the flexible limiter is located at an inner side; and the first limiting mechanisms are capable of being engaged with the outermost two unit bodies of the three adjacent unit bodies to achieve position limiting, under a cooperative action of the rigid limiter and the flexible limiter. The rigid limiter is configured for preventing the unit body from detaching from two ends of the connecting rod, and the flexible limiter is configured for the unit body to be slid through. The flexible limiter will deform when an external force acts thereon.

Preferably, the rigid limiter is integrally formed on the connecting rod or fixed on the connecting rod through a fastener, and is further configured for preventing the outermost two unit bodies of the three adjacent unit bodies from separating from the connecting rod.

Preferably, the flexible limiter is a damping member integrally formed on the connecting rod or fixed on the connecting rod, the damping member is configured for creating a damping effect onto the unit body in a situation of the unit body sliding on the connecting rod, and the unit body is capable of sliding back and forth on the damping member under an action of an external force.

Preferably, the damping member includes, but is not limited to, an elastic hook, a metal elastic sheet, and a rubber member.

Preferably, each of the multiple unit bodies is provided with the second limiting mechanisms, and each of the second limiting mechanisms is capable of realizing position limiting by means of clamping, bonding or sucking. Every two adjacent unit bodies are clamped, bonded or sucked together, when the retractable massage roller is in the contracted state; and the every two adjacent unit bodies will be separated, when a force is applied to pull the retractable massage roller (the force is greater than the clamping force, the bonding force of sucking force).

Preferably, an outer circumference of each of the multiple unit bodies is provided with multiple soft massage portions. Thus, the retractable massage roller can massages and relaxes muscles of a user, when the user uses the retractable massage roller.

Preferably, a middle portion of each of the multiple connecting rods is provided with a convex portion, and the unit body located in a middle of the three adjacent unit bodies is tightened through the convex portion in a situation of the retractable massage roller is in the stretched state. Thus, a stability of the every three adjacent unit bodies after stretching of the retractable massage roller is guaranteed.

DETAILED DESCRIPTION OF EMBODIMENTS

Preferred embodiments of the disclosure will be described hereinafter in detail with reference to accompanying drawings, so that advantages and features of the disclosure can be more easily understood by those skilled in the art, and thus the protection scope of the disclosure is more clearly defined.

Figure 1:
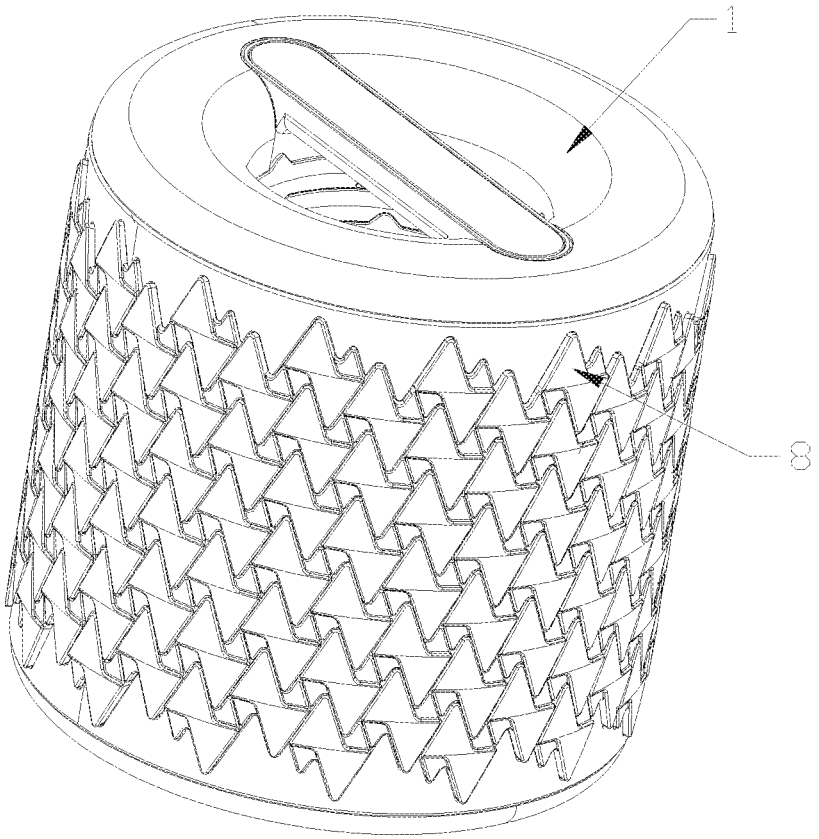
FIG. 1 is a perspective view of a retractable massage roller in a contracted state according to an embodiment.
Figure 2:
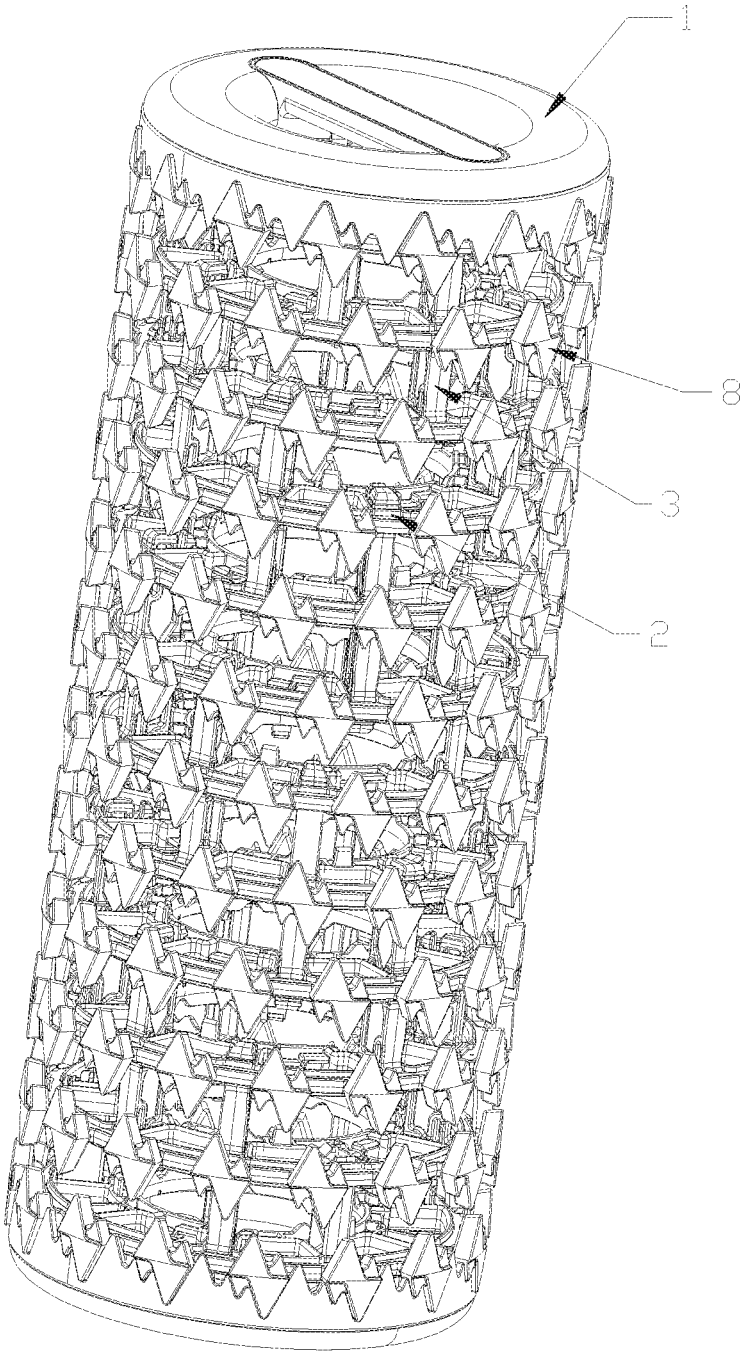
FIG. 2 is a perspective view of the retractable massage roller of FIG. 1 in a stretched state.
Figure 3:
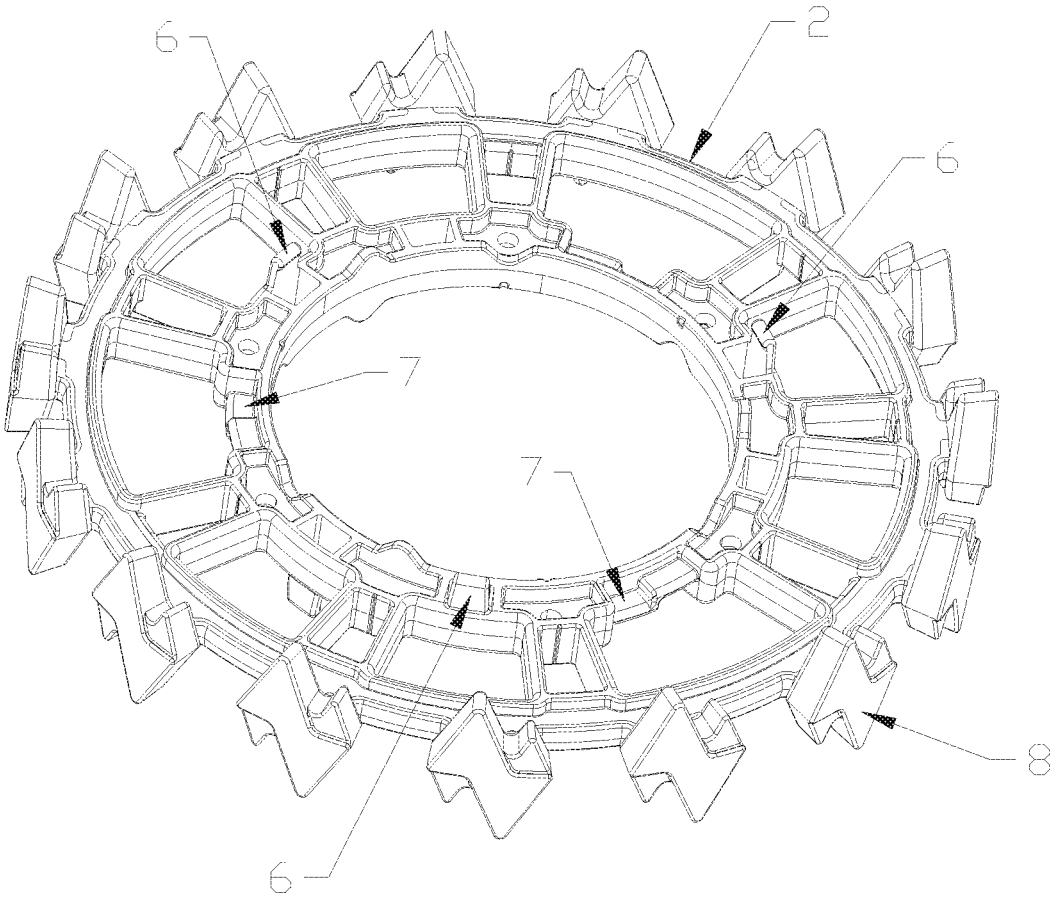
FIG. 3 is a perspective view of a unit body according to an embodiment.
Figure 4:
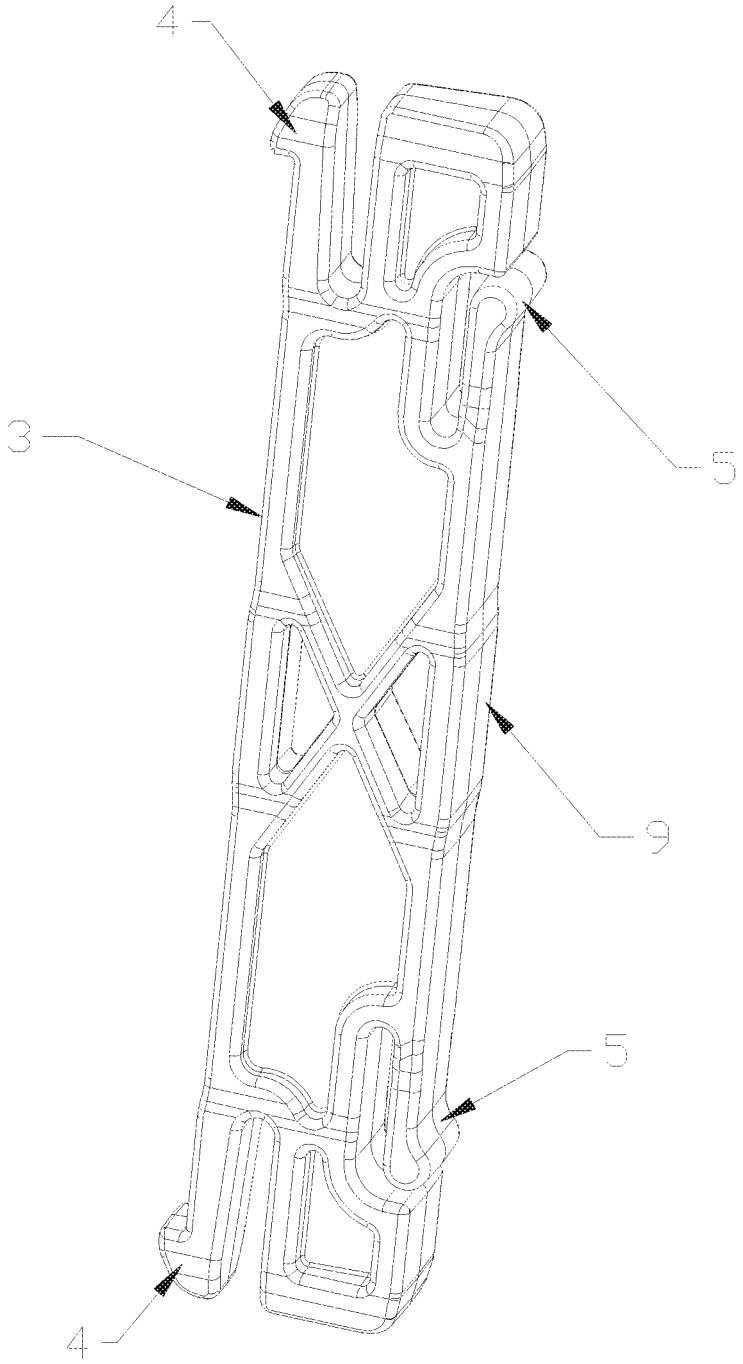
FIG. 4 is a perspective view of a connecting rod according to an embodiment.
Figure 5:
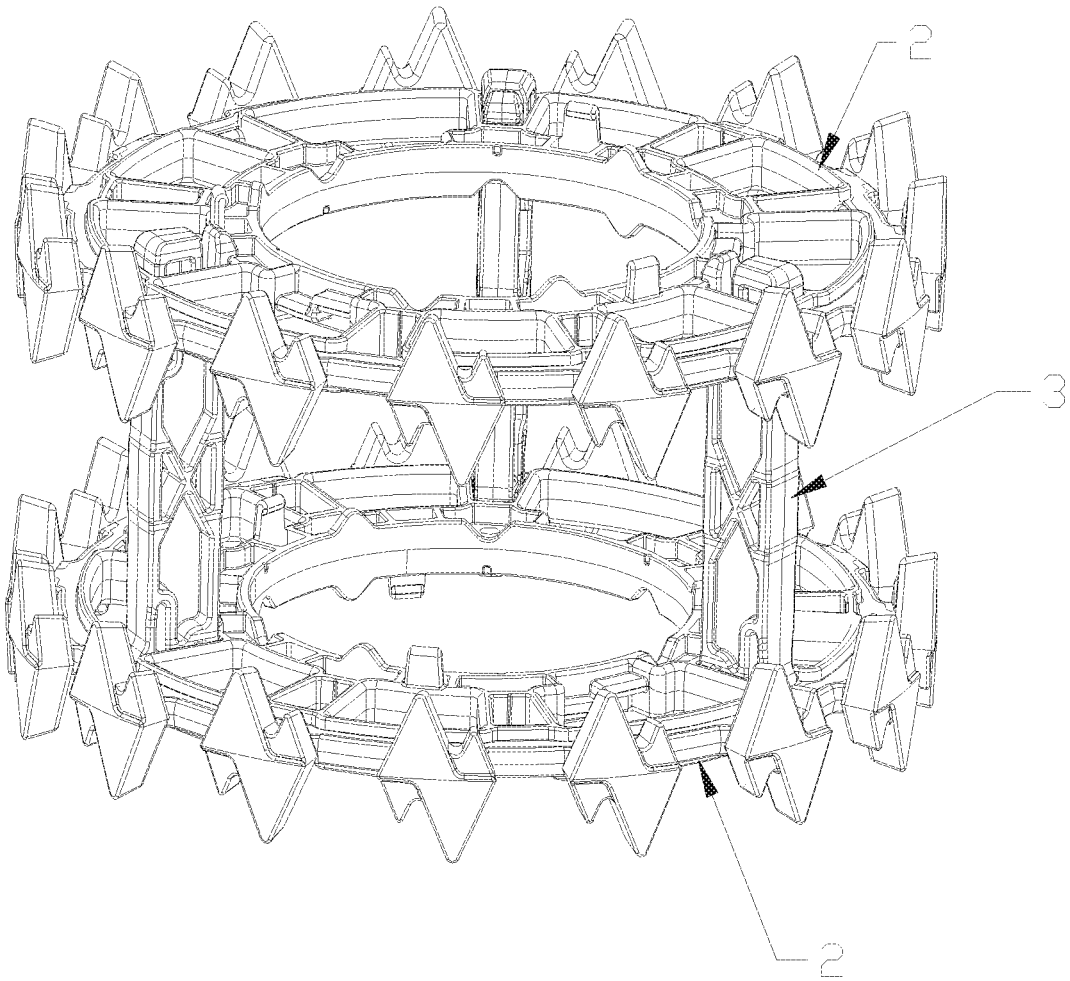
FIG. 5 is a perspective view of outer two unit bodies of every three adjacent unit bodies connecting connecting rods according to an embodiment.

As shown in FIGS. 1-5, a retractable massage roller of the embodiment includes two end caps 1 and multiple ring-shaped unit bodies 2. The multiple ring-shaped unit bodies 2 are arranged along an axial direction, the two end caps 1 are respectively connected to outermost two unit bodies 2 of the multiple unit bodies 2, and every three adjacent unit bodies 2 of the multiple unit bodies 2 are connected through multiple connecting rods 3. The multiple connecting rods 3 are independent of the three adjacent unit bodies 2, each of the multiple connecting rod 3 is movably disposed on and passes through the three adjacent unit bodies 2. Multiple first limiting mechanisms are disposed between the outermost two unit bodies 2 of the three adjacent unit bodies 2 and two ends of each of the multiple connecting rod 3, and are configured for limiting the three adjacent unit bodies 2 on the multiple connecting rods 3 when the retractable massage roller is stretched to both ends thereof in the axial direction by an external force. Multiple second limiting mechanisms 6 are disposed between every two adjacent unit bodies 2 of the multiple unit bodies 2, and configured for connecting the two adjacent unit bodies 2 when the retractable massage roller is contracted by an external force.

In the embodiment, twelve unit bodies 2 and thirty connecting rods 3 are provided. The every three adjacent unit bodies 2 are connected through three connecting rods 3. For example, three adjacent unit bodies such a No. 1 unit body, a No. 2 unit body, and a No. 3 unit body are movably disposed on and passes through three evenly distributed connecting rods 3 to form a first group of unit bodies; three adjacent unit bodies such as a No. 2 unit body, No. 3 unit body and a No. 4 unit body are movably disposed on and passes through three evenly distributed connecting rods 3 to form a second group of unit bodies; three adjacent unit bodies such as a No. 3 unit body, No. 4 unit body and a No. 5 unit body are movably disposed on and passes through three evenly distributed connecting rods 3 to form a third group of unit bodies and so on. During installation, the connecting rods 3 between every two adjacent groups of unit bodies are staggered. For example, the three connecting rods 3 corresponding to the first group of unit body are interlaced with the three connecting rods 3 corresponding to the second group of unit bodies. The three connecting rods 3 corresponding to the second group of unit bodies are interlaced with the three connecting rods 3 corresponding to the third group of unit bodies and so on. In this way, when the retractable massage roller is stretched, the distance between every three adjacent unit bodies 2 is equal, and when the retractable massage roller is contracted, the connecting rods 3 corresponding to every two adjacent groups of unit bodies do not resist each other, for example, the three connecting rods 3 corresponding to the first group of unit bodies are interlaced with the three connecting rods 3 corresponding to the second group of unit bodies, and do not offset each other.

In one embodiment, the first limiting mechanisms are respectively disposed on the two ends of the connecting rod 3. The first limiting mechanism includes a rigid limiter 4 and a flexible limiter 5, the rigid limiter 4 is located at an outer side, and the flexible limiter 5 is located at an inner side, and the first limiting mechanisms are capable of being engaged with the outermost two unit bodies 2 of the three adjacent unit bodies 2 to achieve position limiting, under a cooperative action of the rigid limiter 4 and the flexible limiter 5.

Specifically, the rigid limiter 4 is integrally formed on the connecting rod 3, or fixed on the connecting rod 3 through a fastener such as screw, pin, etc. The rigid limiter 4 may be an L-shaped structure and is further configured for preventing the outermost two unit bodies 2 of the three adjacent unit bodies 2 separating from the connecting rod 3.

The flexible limiter 5 is a damping member integrally formed on the each connecting rod 3 or independently fixed on the connecting rod 3, and includes an elastic hook, a metal elastic sheet or a rubber member. If the elastic hook and the metal elastic sheet is used as the flexible limiter 5, a portion of the elastic hook or metal elastic sheet to be contacted with the unit body 2 can be disposed in an arc transition shape, which is beneficial for the unit body 2 to slide there-through. The damping member is configured for creating a damping effect onto the unit body 2, when the unit body 2 slides on the connecting rod 3; and the unit body 2 is capable of sliding back and forth on the damping member under an action of an external force.

A middle portion of each of the multiple connecting rod 3 is provided with a convex portion 9, and the unit body 2 located in a middle of the three adjacent unit bodies 2 is tightened through the convex portion 9 at the middle portion of the connecting rod 3, when the retractable massage roller is stretched.

The outermost two unit bodies 2 of the three adjacent unit bodies 2 slide through the flexible limiter 5, when the retractable massage roller is contracted or stretched toward both ends thereof by an external force. The outermost two unit bodies 2 of the three adjacent unit bodies are positionally-limited between the rigid limiter 4 and the flexible limiter 5 at each end of the connecting rods 3, and the unit body 2 located in a middle of the three adjacent unit bodies 2 is tightened at the convex portion of the connecting rods 3, when the retractable massage roller is stretched towards the both ends thereof in the axial direction by the external force. In case that the retractable massage roller is contracted toward an axial center under the action of an external force, the outermost two unit bodies 2 of the every three adjacent unit bodies 2 slide over the flexible limiter 5 and break away from the position limiting defined by the rigid limiter 4 and the flexible limiter 5 at the each end of the connecting rods 3, and thus the every three adjacent unit bodies 2 are located at any position between the two flexible limiters 5 of the connecting rod 3.

The multiple second limiting mechanisms 6 is provided on each unit body 2, and each second limiting mechanism 6 is capable of realizing position limiting by means of clamping, bonding or sucking.

If the second limiting mechanism 6 realizes the position limiting by means of clamping, the second limiting mechanism 6 may be a metal elastic sheet or an elastic hook. In the embodiment, the second limiting mechanism 6 is an elastic hook, and each adjacent unit body 2 is provided with multiple engaging grooves 7 corresponding to the elastic hooks. In an actual operation, each end surface of the each unit body 2 is provided with elastic hooks and engaging grooves 7, and a portion where the elastic hook used as the second limiting mechanism 6 contacts the unit body 2 has a transition arc shape, which is beneficial to the unit body 2 to be slid through the second limiting mechanism 7, every two adjacent unit bodies 2 are locked by their respective elastic hooks and the engaging grooves 7 cooperated with each other to achieve the position limiting. In case that the retractable massage roller is contracted by an external force applied by a user, the elastic hook is engaged with the engaging groove 7 of the unit body 2 adjacent thereto. In case that an external force is applied by the user to stretch the retractable massage roller towards both ends thereof in the axial direction, the elastic hook used as the second limiting mechanism 6 of the each unit body disengages from the engaging groove 7 of a unit body adjacent to the unit body, and the every two adjacent unit bodies 2 are not longer in an engagement state, and then are separated from each other.

If the second limiting mechanism 6 realizes the position limiting by means of bonding, a magnetic portion with magnetic suction force is required to be provided on every two adjacent unit bodies 2. In case that the retractable massage roller is contracted by an external force applied by a user, the every two adjacent unit bodies 2 are positionally-limited by the adsorption of the magnetic portions; and in case that an external force is applied by the user to stretch the retractable massage roller towards both ends thereof in the axial direction, the every two adjacent unit bodies 2 are not longer in an engagement state, and then are separated from each other when the external force is much greater than an adsorption force between the magnetic portions.

If the second limiting mechanism 6 realizes the position limiting by means of sucking, components such as velcro that can be adhered to each other are required to be provided on every two adjacent unit bodies 2. In case that the retractable massage roller is contracted by an external force applied by a user, the position limiting between the every two adjacent unit bodies 2 is achieved through the components such as velcro; and in case that an external force is applied by the user to stretch the retractable massage roller towards both ends thereof in the axial direction, the every two adjacent unit bodies 2 are not longer in an engagement state, and then are separated from each other when the external force is much greater than an adsorption force between the magnetic portions.

An outer circumference of each of the multiple unit bodys 2 is provided with multiple soft massage portions 8 and is configured for massage a user when the retractable massage roller is stretched.

The above embodiments are only for explaining the technical concepts and features of the disclosure, and the purpose thereof is to allow those familiar with the technology to understand the contents of the disclosure and implement them, but is not intended to limit a protection scope of the disclosure. All equivalent changes or modifications made according to the spirit of the disclosure should be covered in the protection scope of the disclosure.

What is claimed is:

1. A retractable massage roller comprising: two end caps and a plurality of ring-shaped unit bodies arranged along an axial direction, the two end caps being respectively connected to outermost two unit bodies of the plurality of unit bodies;

wherein every three adjacent unit bodies of the plurality of unit bodies are connected through a plurality of connecting rods, the plurality of connecting rods are independent of the three adjacent unit bodies, each of the plurality of connecting rods is movably disposed on and passes through the three adjacent unit bodies and thereby the three adjacent unit bodies are capable of sliding on each of the plurality of connecting rods;

wherein outermost two unit bodies of the three adjacent unit bodies are respectively positionally-limited at two ends of each of the plurality of connecting rods through first limiting mechanisms, in a situation of the retractable massage roller being in a stretched state; and wherein every two adjacent unit bodies of the plurality of unit bodies are positionally-limited through second limiting mechanisms, in a situation of the retractable massage roller being in a contracted state;

wherein each of the first limiting mechanisms comprises a rigid limiter and a flexible limiter;

wherein each of the second limiting mechanisms is a metal elastic sheet or an elastic hook.

2. The retractable massage roller according to claim 1, wherein the first limiting mechanisms are respectively disposed on the two ends of each of the plurality of connecting rods, the rigid limiter is located at an outer side of each of the plurality of connecting rods, and the flexible limiter is located at an inner side of each of the plurality of connecting rods; and the first limiting mechanisms are capable of being engaged with the outermost two unit bodies of the three adjacent unit bodies to achieve position limiting, under a cooperative action of the rigid limiter and the flexible limiter.

3. The retractable massage roller according to claim 2, wherein the rigid limiter is integrally formed on each of the plurality of connecting rods or fixed on each of the plurality of connecting rods through a fastener, and is further configured for preventing the outermost two unit bodies of the three adjacent unit bodies from separating from each of the plurality of connecting rods.

4. The retractable massage roller according to claim 2, wherein the flexible limiter is a damping member integrally formed on each of the plurality of connecting rods or fixed on each of the plurality of connecting rods, the damping member is configured for creating a damping effect onto one of the outermost two unit bodies in a situation of the unit body sliding on the connecting rod, and the one of the outermost two unit bodies is capable of sliding back and forth on the damping member under an action of an external force, wherein the damping member comprises an elastic hook, a metal elastic sheet or a rubber member.

5. The retractable massage roller according to claim 1, wherein each of the plurality of unit bodies is provided with the second limiting mechanisms-, and each of the second limiting mechanisms is capable of realizing position limiting by means of clamping, bonding or sucking.

6. The retractable massage roller according to claim 1, wherein an outer circumference of each of the plurality of unit bodies is provided with a plurality of soft massage portions.

7. The retractable massage roller according to claim 1, wherein a middle portion of each of the plurality of connecting rods is provided with a convex portion-, and the unit body located in a middle of the three adjacent unit bodies is tightened through the convex portion in the situation of the retractable massage roller is in the stretched state.

* * * * *